US005535452A

United States Patent [19]

Rozenblat

[11] Patent Number: 5,535,452

[45] Date of Patent: Jul. 16, 1996

[54] MAN'S REMOVABLE BRIEF TO BE REMOVED WHILE WEARING AN OUTER GARMENT

[76] Inventor: Sofia Rozenblat, 6868-L Hyde Park Dr., San Diego, Calif. 92119

[21] Appl. No.: 306,615

[22] Filed: Sep. 15, 1994

[51] Int. Cl.[6] ..... A41B 9/02

[52] U.S. Cl. ..... 2/403; 2/78.2

[58] Field of Search ..... 2/403, 400, 405, 2/408, 78.2, 78.3

[56] References Cited

U.S. PATENT DOCUMENTS 2,335,658 11/1943 Fishbein ..... 2/403

3,145,394 8/1964 Melton ..... 2/403

3,486,501 12/1969 Erickson et al. ..... 602/67

*Primary Examiner*—C. D. Crowder

*Assistant Examiner*—Gloria Hale

[57] ABSTRACT

A man's removable brief which allows easy removal while wearing an outer garment, the brief comprises: an elastomeric waistband having a frontal opening closeable with hook and eye fasteners; a torso surrounding web portion between the waistband and leg opening; and a crotch web positioned between the leg openings; a two fabric layer front panel permanently attached at one end of the crotch and removable attached along sloping side edges by slide fastening members. There are cutouts in front panel for access to inside a brief. Buttons and press-buttons can be used instead of slide fasteners.

1 Claim, 2 Drawing Sheets

MAN'S REMOVABLE BRIEF TO BE REMOVED WHILE WEARING AN OUTER GARMENT

BACKGROUND OF THE INVENTION

1. Field of the invention

It relates to underwear garments. Specifically to men's briefs and shorts with additional possibilities for usage in different life conditions.

2. Description of the Prior Art

The search of Patents class 2 subclass 403 was fulfilled according to the Official Gazette Publication of the U.S. Patent and Trademark Office. The record obtains the number of patents including July 1994.

In U.S. Pat. No. 2,335,658 1943 Frank Fishbein discloses a removable bathing trunk. Analysis of its design shows that it is unattractive for the following reasons:

(a) absence of elastomeric waistband or other type of adjustable belt makes usage of the trunk almost impossible;

(b) the central longitunal removable panel with two layers (10*b*, 12) sewed together and two slide fasteners (14*a*, 14*m*) form a rigid construction that doesn't give the possibility to make comfort conditions for a wearer;

(c) the said panel has a broad supporter for only one aim - to have fastener members at both sides of the panel for preliminary handing up a panel at a waistband;

(d) the design of the trunk is too complicated. It is difficult to manufacture. It is almost not workable. In the U.S. Pat. No. 3,145,394, 1964 G. A. Melton discloses a removable invalid diaper for adults in nursing homes. Diaper holds on somebody only because a man is bandaged and a diaper is adjusted with some fasteners. It is difficult for self serving. In the U.S. Pat. No. 4,702,239, 1986 Ichikawa discloses an underwear garment comprising a long hip, crotch and belly covering portion: It can be changed easily while wearing an outer garment. But it requires too much time for fixing and it is not comfortable and safe enough. Therefore, a user can find himself naked. Such design is not satisfactory. In the U.S. Pat. No. 5,172,430, 1991, Lerma-Solis and Dupont Registered Trademark 1992 discloses nondetachable men's briefs. Conclusion. There is a continuing need for a new and improved brief as set forth by the instant invention which resolved both problems of effectiveness in construction and convenience of usage.

SUMMARY OF THE INVENTION

In view of the foregoing disadvantages inherent in the known types of man's briefs now presented in the prior art, the present invention provides a new improved type of man's brief. The new design of man's brief has the following different chief characteristic features:

(a) the elastomeric waistband has a frontal opening closeable with a hook and eye fastener;

(b) the torso surrounding web portion sized and shaped for surrounding the hips and the back side of the wearer have a frontal opening with two symmetrical sloping side edges according to a front panel special size and shape;

(c) said front panel being wide below the area adjacent leg openings at the crotch and being narrow above the area adjacent the waistband;

(d) the said front panel permanently attached at one end at the crotch and removable attached along sloping sides of torso surrounding the web by slide fastening members;

(e) the elastomeric waistband with the waistband fastener and the front fastened panel allow easy removal of the brief when unfastened while the outer worn garments are still on the wearer.

DESCRIPTION OF THE PREFERRED EMBODIMENT

Figure 1:
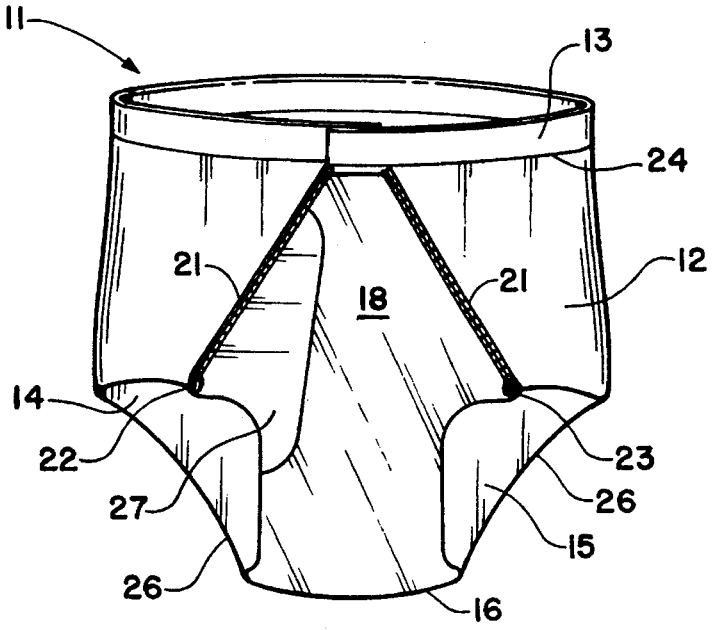
FIG. 1 is a frontal view taken in elevation of a man's removable brief in a position with a closed waistband and also closed slide fasteners which connect two layered front panel and side parts of torso surrounding web.
Figure 2:
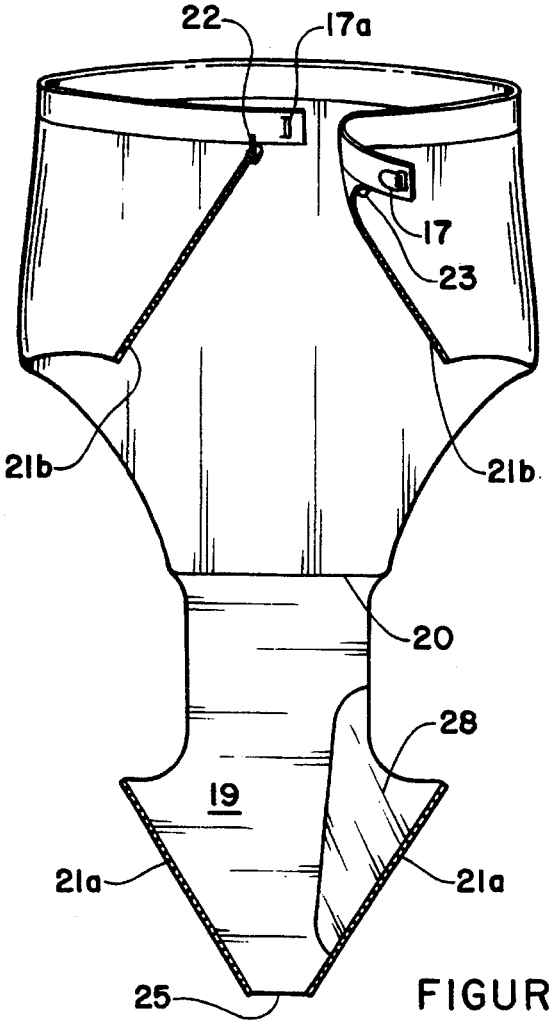
FIG. 2 is a frontal view taken in elevation of a man's removable brief in a position with a closed waistband and opened slide fasteners which connect two layered forward panel and side parts of torso surrounding the web.
Figure 3:
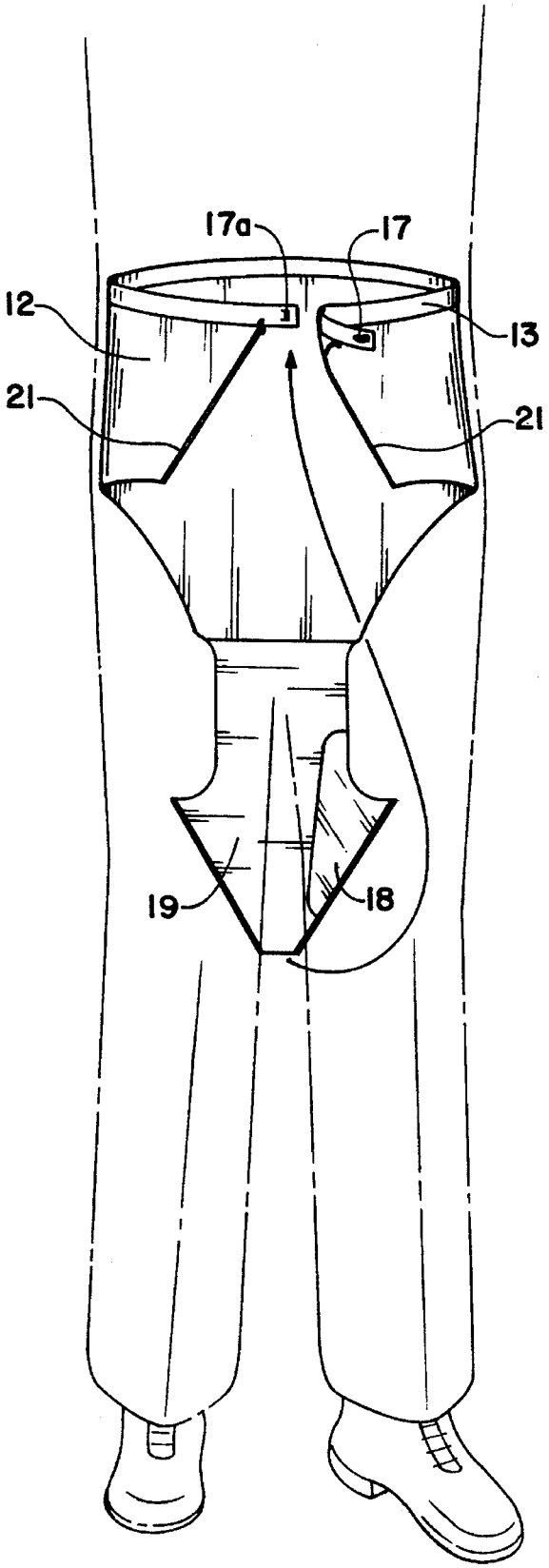
FIG. 3 is a picture of changing the removable man's underwear brief without taking off the outer worn garments.

There is shown in FIG. 1 to FIG. 3 a new improved design of a removable man's brief 11. It comprises of:

an elastomeric waistband 13 having a frontal opening closable with a hook 17 and eye 17*a* fastener;

a lower torso surrounding web 12 portion sized and shaped for surrounding the hips and back side of the wearer with two symmetrical sloping side edges 21*b*, each located at their respective front hip area wherein the torso surrounding web 12 is attached along a top edge 24 to the elastomeric waistband 13 and having a lower edge 26 that curves along each respective leg 14 and 15 with a strait edge at the crotch 16;

a front panel being constructed of two fabric layers 18 and 19 permanently attached at one end 20 of the crotch 16 and removable attached along the sloping side edges by slide fastening members 21, slides 22 (left side) and 23 (right side).

In a closed position of the slide fasteners 21 both slides 22 and 23 are located in a lower place as shown on FIG. 1. In an open position of the slide fastener both slides 22 and 23 are rested on the side edge of slide-line 21*b* as shown on FIG. 2. The top edge 25 is unattached to the elastomeric waistband.

Each of both layers (18 and 19) of the front panel has a cutout (27 and 28 accordingly). Both located along sloping edges, symmetrically to the axis of the front panel, so as to provide access to inside the brief at the front panel.

What is claimed:

1. A man's brief which allows easy removal while wearing an outer garment comprising:

an elastomeric waistband having a frontal opening closeable with a hook and eye fastener;

a lower torso surrounding web portion sized and shaped for surrounding the hips and back side of the wearer with two symmetrical sloping side edges each located at their respective front hip area wherein the torso surrounding web is attached along a top edge to the elastomeric waistband and having a lower edge that curves along each respective leg with a straight edge therebetween at the crotch of the wearer;

a front panel permanently attached at one end at the crotch and removably attached along said sloping side edges by slide fastening members;

said front panel being constructed of two fabric layers;

said front panel being wide below the area adjacent leg openings at the crotch of the wearer and being narrow above at the area adjacent the waistband with an unattached straight top edge that runs along the elastomeric waistband;

and wherein the elastomeric waistband with the waistband fastener and the frontal fastened panel allow easy removal of the briefs when unfastened while the outer worn garments are still present on the wearer.

* * * * *